US011913288B2

(12) United States Patent
Aug et al.

(10) Patent No.: US 11,913,288 B2
(45) Date of Patent: Feb. 27, 2024

(54) DRILLING MACHINE FOR ANGLED DRILLING

(71) Applicant: Epiroc Drilling Solutions, LLC, Garland, TX (US)

(72) Inventors: Keith Daniel Aug, Rockwall, TX (US); James Benson, Rowlett, TX (US); Nathan Lundry, Garland, TX (US)

(73) Assignee: Epiroc Drilling Solutions, LLC, Garland, TX (US)

( * ) Notice: Subject to any disclaimer, the term of this patent is extended or adjusted under 35 U.S.C. 154(b) by 568 days.

(21) Appl. No.: 17/147,857

(22) Filed: Jan. 13, 2021

(65) Prior Publication Data

US 2022/0220811 A1 Jul. 14, 2022

(51) Int. Cl.

| | |
|---|---|
| ***B66C 23/06*** | (2006.01) |
| ***E21B 7/04*** | (2006.01) |
| ***E21B 15/04*** | (2006.01) |
| *E21B 7/02* | (2006.01) |

(52) U.S. Cl.

CPC ..... *E21B 15/04* (2013.01); *E21B 7/04* (2013.01); *E21B 7/02* (2013.01)

(58) Field of Classification Search

CPC ..... E21B 7/04; E21B 15/04

See application file for complete search history.

(56) References Cited

U.S. PATENT DOCUMENTS

| | | | | |
|---|---|---|---|---|
| 2,255,241 A * | 9/1941 | Brown | E21B 7/021 173/147 |
| 2,598,454 A * | 5/1952 | Smith | E21B 15/04 173/127 |
| 2,849,212 A | 8/1958 | Davis | |
| 3,181,630 A * | 5/1965 | Coburn | E21B 19/20 173/147 |

(Continued)

FOREIGN PATENT DOCUMENTS

| | | |
|---|---|---|
| CN | 101881134 B | 1/2014 |
| EP | 2336481 A1 | 6/2011 |

(Continued)

OTHER PUBLICATIONS

International Search Report, PCT/US2021/029088, dated Oct. 13, 2021.

(Continued)

*Primary Examiner* — Basil S Katcheves

(74) *Attorney, Agent, or Firm* — Harper & Bates LLP; Shannon W. Bates

(57) ABSTRACT

A drilling machine for angled drilling has a platform having a longitudinal axis and a transverse axis. The drilling machine includes a tower for holding a drill string and a tower interface assembly connected to the platform, so that the tower interface assembly moveably supports the tower. The tower interface assembly is selectively moveable to tilt the tower in either a plane parallel with the longitudinal axis of the platform, or to tilt the tower in a plane parallel with the transverse axis of the platform, so that the tilted drill (Continued)

string can perform angled drilling in either position. Further, the tower interface assembly is selectively moveable to simultaneously tilt the tower in the plane parallel with the longitudinal axis of the platform, and the plane parallel with the transverse axis of the platform.

14 Claims, 11 Drawing Sheets

(56) References Cited

U.S. PATENT DOCUMENTS

| | | | | |
|---|---|---|---|---|
| 3,301,334 | A | 1/1967 | Odgers | |
| 3,520,374 | A | 7/1970 | Ebert | |
| 3,670,831 | A * | 6/1972 | Winter, Jr. | E21B 7/027 173/28 |
| 3,869,003 | A | 3/1975 | Yamada et al. | |
| 4,049,065 | A | 9/1977 | Walter | |
| 4,434,860 | A | 3/1984 | Deyo | |
| 4,455,116 | A | 6/1984 | Lindstedt et al. | |
| 5,050,673 | A * | 9/1991 | Baldridge | E21B 7/02 166/70 |
| 5,158,146 | A * | 10/1992 | Fuller | E21B 7/026 175/203 |
| 5,201,816 | A * | 4/1993 | Schivley, Jr. | E21B 15/04 173/28 |
| 5,226,488 | A | 7/1993 | Lessard et al. | |
| 5,310,011 | A * | 5/1994 | Kaakkurivaara | E21B 15/04 173/28 |
| 5,647,442 | A | 7/1997 | Lange | |
| 6,637,525 | B2 | 10/2003 | Watanabe et al. | |
| 6,814,164 | B2 | 11/2004 | Mills et al. | |
| 8,782,968 | B2 | 7/2014 | Benson | |
| 9,026,270 | B2 | 5/2015 | Poettker et al. | |
| 10,316,540 | B2 | 6/2019 | Zhao et al. | |
| 2006/0096783 | A1* | 5/2006 | Landry | E21B 19/14 52/118 |
| 2008/0110657 | A1* | 5/2008 | Gunnarson | E21B 7/02 173/184 |
| 2010/0065335 | A1* | 3/2010 | Wrede | E21B 7/025 175/220 |
| 2011/0162296 | A1* | 7/2011 | Benson | E21B 15/04 52/116 |
| 2012/0279782 | A1* | 11/2012 | O'reilly | G01B 11/27 33/263 |

FOREIGN PATENT DOCUMENTS

| | | | |
|---|---|---|---|
| EP | 3719247 | A1 | 9/2020 |
| JP | 11-256972 | A | 9/1999 |
| RU | 2057884 | C1 | 4/1996 |
| WO | 2011126362 | A1 | 10/2011 |
| WO | 2019000037 | A1 | 1/2019 |

OTHER PUBLICATIONS

Opinion of International Searching Authority, PCT/US2021/029088, dated Oct. 13, 2021.

General Drilling, Inc., "Drill Rig Types", http://www.generaldrilling.com/drill-rig-types.html, accessed Jan. 11, 2021.

Dando Drilling International, "Angle Drilling Dando Terrier", https://www.dando.co.uk/products/angle-drilling-terrier/, accessed Jan. 11, 2021.

Oil and Gas Journal, "Slant rigs offer big payoff in shallow drilling", https://www.ogj.com/articles/print/volume-90/issue-13/in-this-issue/drilling/slant-rigs-offer-big-payoffs-in-shallow-drilling.html, accessed Jan. 11, 2021.

Visser & Smit Hanab, "Slant Drilling", https://www.vshanabdrilling.com/en/trenchless-technologies/special-technologies/slant-drilling, accessed Jan. 11, 2021.

* cited by examiner

DRILLING MACHINE FOR ANGLED DRILLING

BACKGROUND

Technical Field

This disclosure relates to drilling machines, in particular, drilling machines having towers capable of tilting for angled drilling.

Background

There are many different types of drilling machines for drilling through a formation. Some of these drilling machines are mobile and others are stationary. A typical mobile drilling machine includes a vehicle and tower, wherein the tower carries a rotary head and drill string. In operation, the drill string is driven into the formation by the rotary head.

In some situations, it is desirable to drill at an angle. Drilling at an angle is useful so that more regions of a formation can be reached with the drill string. For example, in some situations, the drilling machine cannot be positioned directly over a desired region of the formation, so it is not possible to drill straight down and reach this region of the formation. Hence, angled drilling is useful so that the drilling machine can reach a desired region of a formation without being directly over it. In this way, there are many more options available when selecting the location to position the drilling machine. Angled drilling is also particularly useful in blast-hole drilling in the mining industry, but the reader should note that this disclosure, and the claims set out here, are not limited to blast-hole drilling applications, but could be useful in all types of earth drilling U.S. Pat. No. 8,782,968 discloses a tower support assembly for angled drilling, the specification of which patent is incorporated by reference in its entirety into the present application, but which is not admitted to be prior art by its incorporation into this background section.

Angled drilling is typically accomplished by tilting the tower relative to an axis of the drilling machine so that the drill string is tilted along with the tower. Prior-art drilling machines are only capable of tilting in one plane. It would be desirable to have drill towers capable of tilting in more than one plane, along with better control of the angle or angles to which the tower is tilted, while also providing stability to the tower when it is in a tilted condition.

DRAWINGS

Non-limiting embodiments of the present disclosure are described by way of example in the following drawings, which are schematic and are not intended to be drawn to scale:

SUMMARY

In accordance with one embodiment, a drilling machine for angled drilling has a platform having a longitudinal axis and a transverse axis. The drilling machine includes a tower for holding a drill string and a tower interface assembly connected to the platform, so that the tower interface assembly moveably supports the tower. In various embodiments disclosed, the tower interface assembly is selectively moveable to tilt the tower in either a plane parallel with the longitudinal axis of the platform, or to tilt the tower in a plane parallel with the transverse axis of the platform, so that the tilted drill string can perform angled drilling in either position. Further, the tower interface assembly is selectively moveable to simultaneously tilt the tower in the plane parallel with the longitudinal axis of the platform, and the plane parallel with the transverse axis of the platform. Further still, the drilling machine may be selectively moveable to first tilt the tower in the plane parallel with the longitudinal axis of the platform, and thereafter to tilt the tower in the plane parallel with the transverse axis of the platform, or the reverse procedure, respectively. This Summary is provided to introduce a selection of concepts in a simplified form that are further described below in the Detailed Description. This Summary is not intended to identify key features or essential features of the claimed subject matter, nor is this Summary intended to be used to limit the scope of the claimed subject matter.

DETAILED DESCRIPTION

Figure 1:
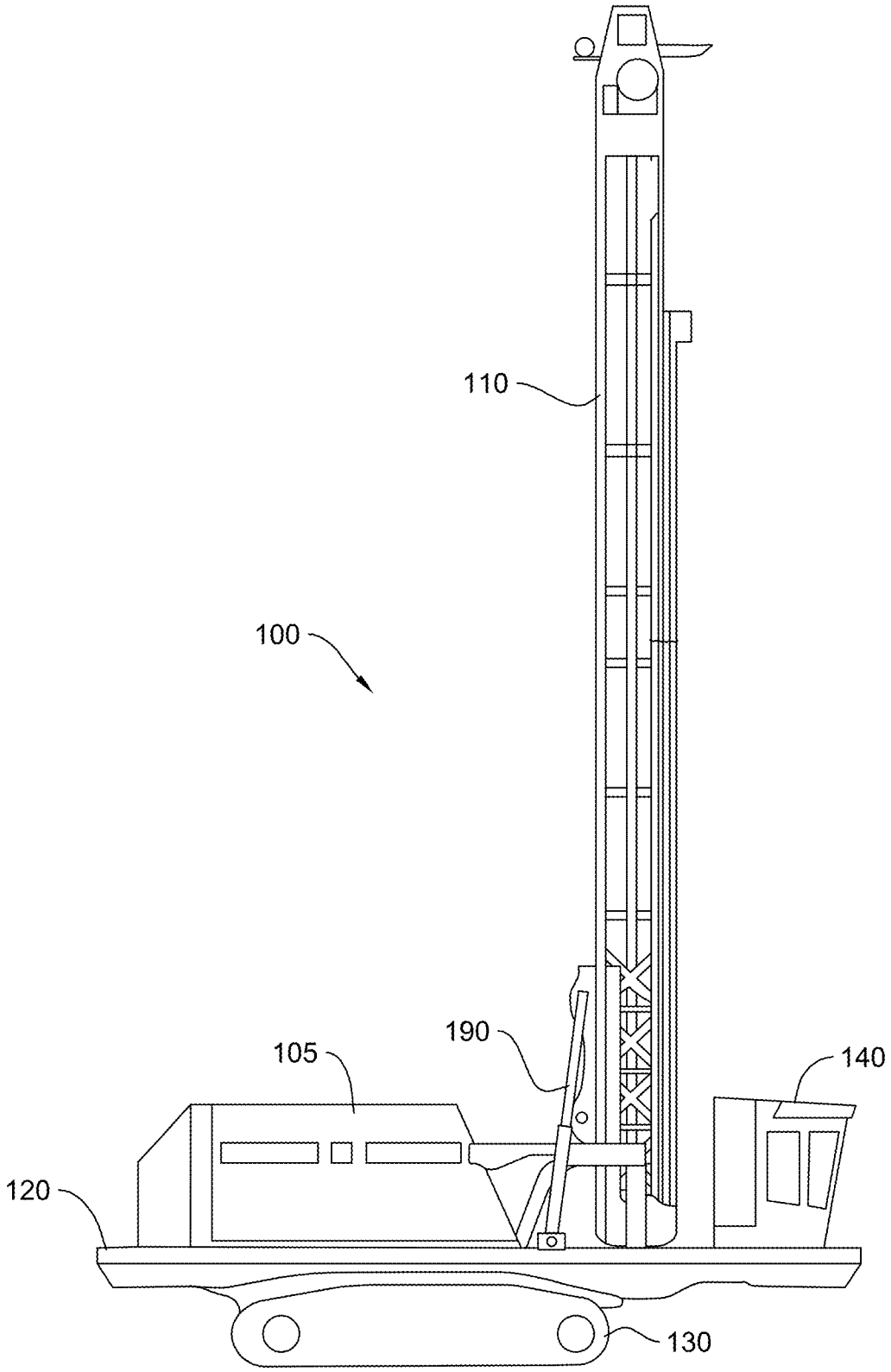
FIG. 1 shows a side view of an embodiment of a typical drilling machine having a tower capable of tilting, where the tower is raised to a vertical position.

FIG. 1 shows a side view of a typical mobile drilling machine 100. The drilling machine has a tower 110, a platform 120 supporting the tower 110, and typically tracks 130 or wheels for propelling the drilling machine over ground. FIG. 1 also shows an operator's cab 140 situated on the platform 120. The term "cab" in this disclosure refers to either a housing for an operator or a workstation location on the platform 120, which may or may not be occupied by an operator, as would be the case in autonomous machines. Except in FIG. 1, the typical engine compartment or "power pack" 105, and mechanical accessories of a drilling machine 100 are omitted for clarity. The tower 110 will also carry a rotary head and a drill string extending through the tower, but these components are conventional and will not be discussed further. The reader should note that the improvements disclosed here could be embodied in a fixed drilling machine as well as a mobile machine.

The drilling machine 100 typically includes a control system (not shown), which is operatively coupled to the power pack 105. The control system includes one or more control inputs which can be adjusted by the operator in the operator's cab 140. Further, the control system will include one or more input controls for controlling the operation of the tower 110, including its tilt angle or angles, which operation will be discussed in more detail below.

Figure 2:
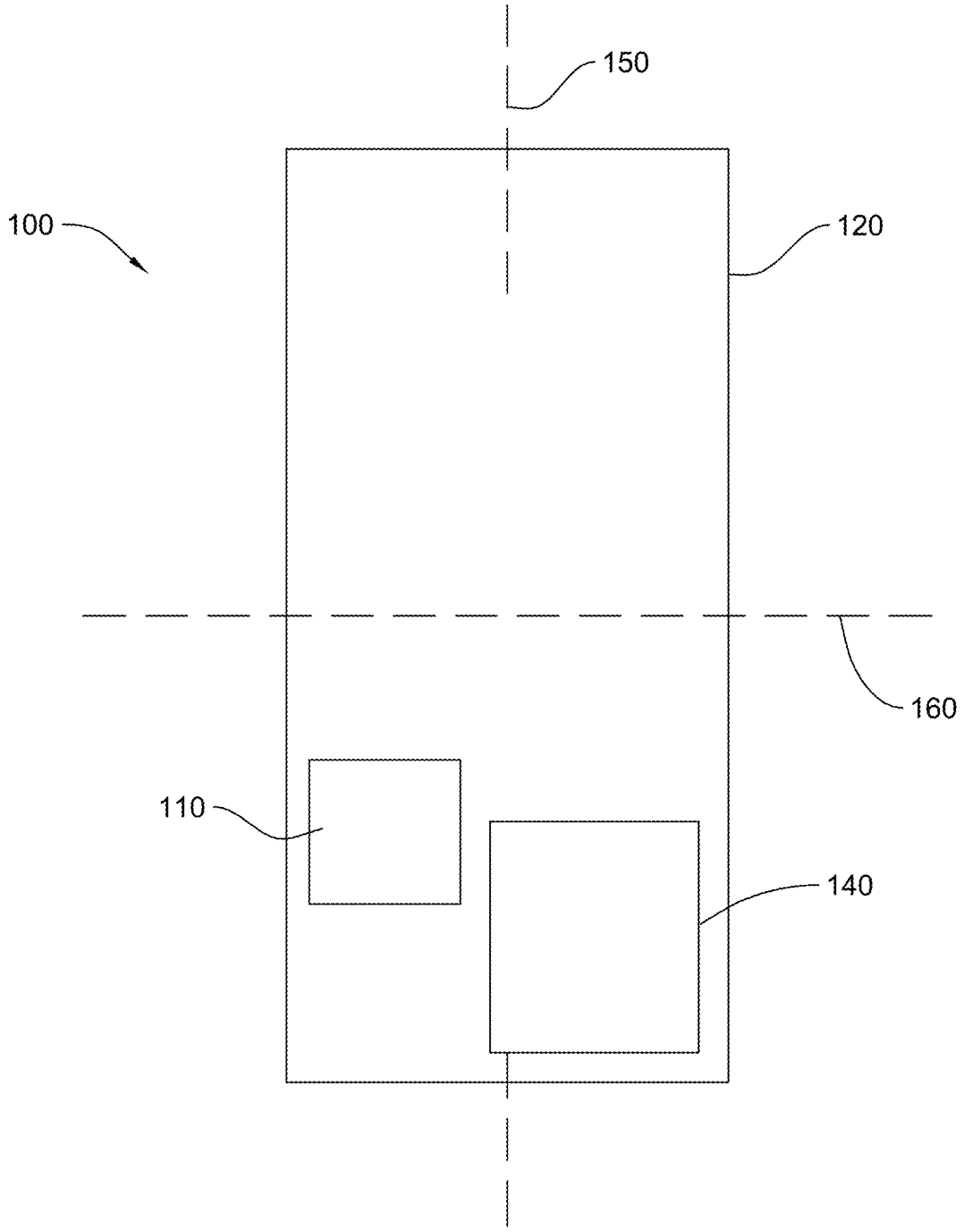
FIG. 2 shows a schematic plan view of a typical drilling machine platform, illustrating the longitudinal and transverse axes of the drilling machine platform used as references for the purposes of this disclosure.

FIG. 2 schematically shows a plan view of the platform 120 of a drilling machine 100, typically rectangular, defining a longitudinal axis 150 of the platform 120 and defining a transverse axis 160 of the platform 120, perpendicular to the longitudinal axis 150. In this disclosure, the longitudinal axis 150 and the transverse axis 160 of the platform 120, as defined in FIG. 2, will be used to illustrate the direction of tilt of the tower 110 with respect to the platform 120 and the cab 140.

Figure 3:
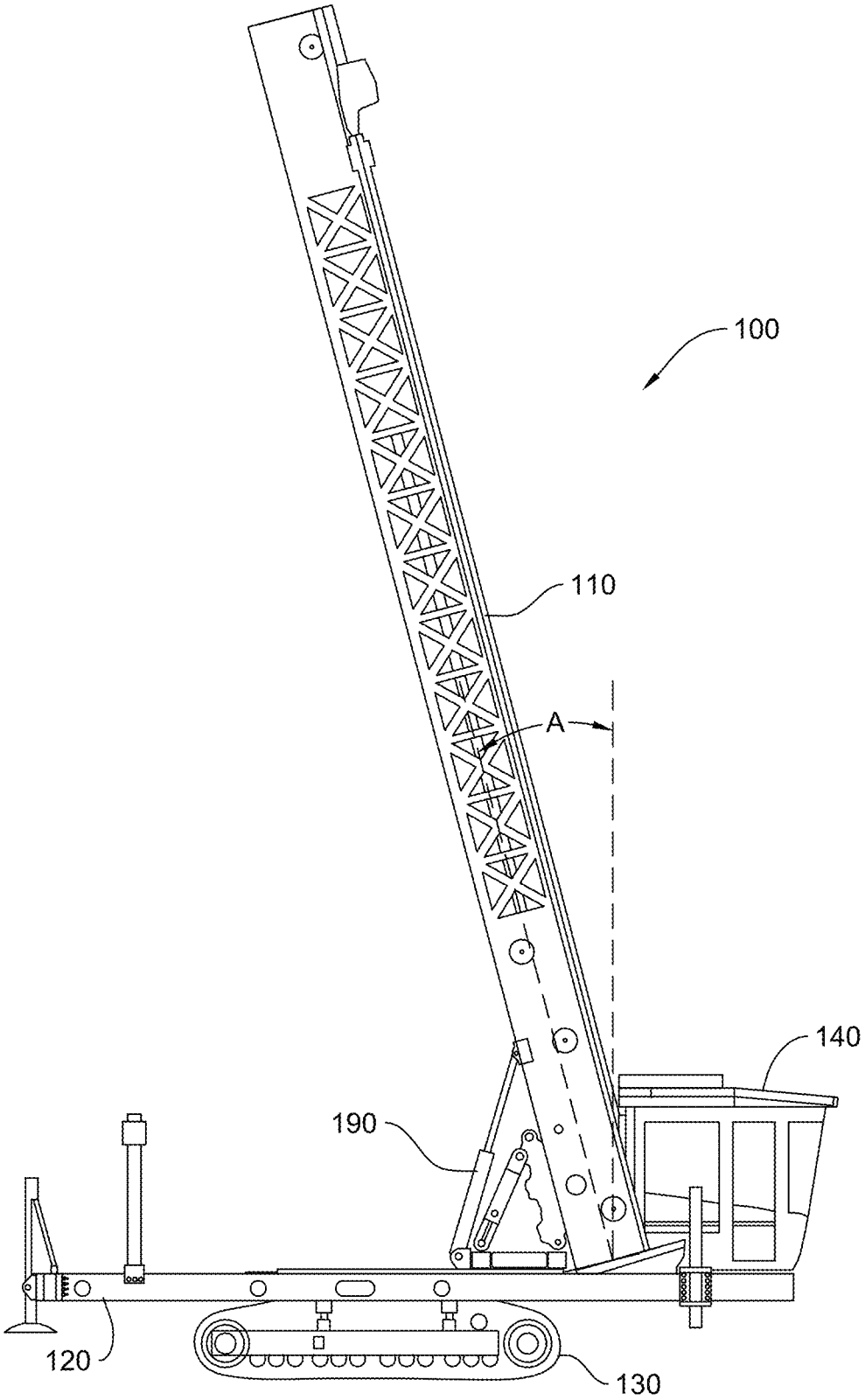
FIG. 3 shows a side view of a typical drilling machine, where the view is into the transverse axis of the drilling machine, further showing a tower tilted in the plane of the longitudinal axis.
Figure 4:
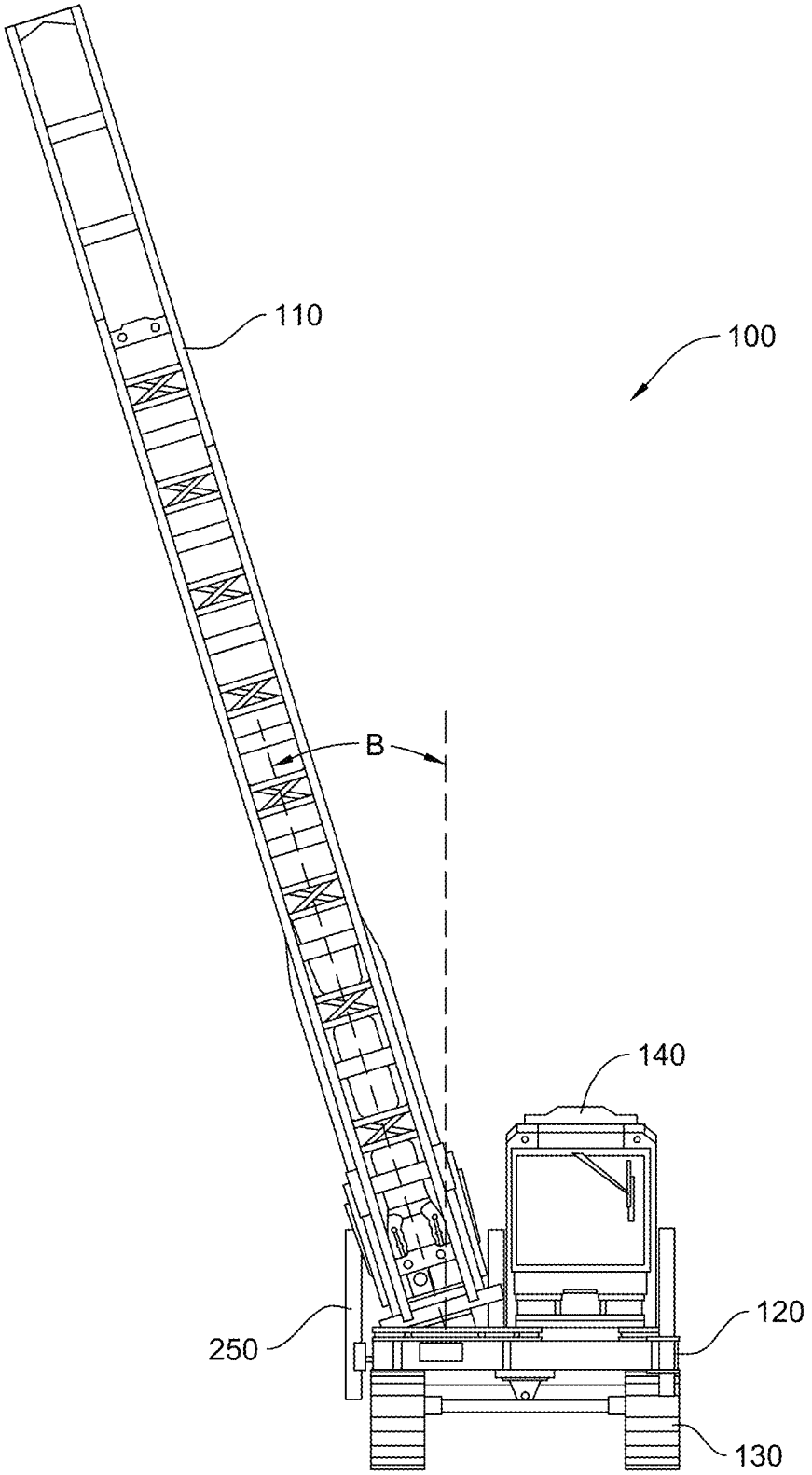
FIG. 4 shows a front view of a typical drilling machine, where the view is into the longitudinal axis of the drilling machine, further showing a tower tilted in the plane of the transverse axis.

FIG. 3 shows a side view of a typical drilling machine 100, where the view is into the transverse axis 160 of the drilling machine 100, further showing a tower 110 tilted in the plane of the longitudinal axis 150. The tower 110 is shown tilted from the vertical by an angle "A". FIG. 4 shows a front view of a typical drilling machine 100, where the view is now into the longitudinal axis 150 of the drilling machine 100, further showing a tower 110 tilted in the plane of the transverse axis 160. In FIG. 4, the tower 110 is shown tilted from the vertical by an angle "B".

First Embodiment

Figure 5:
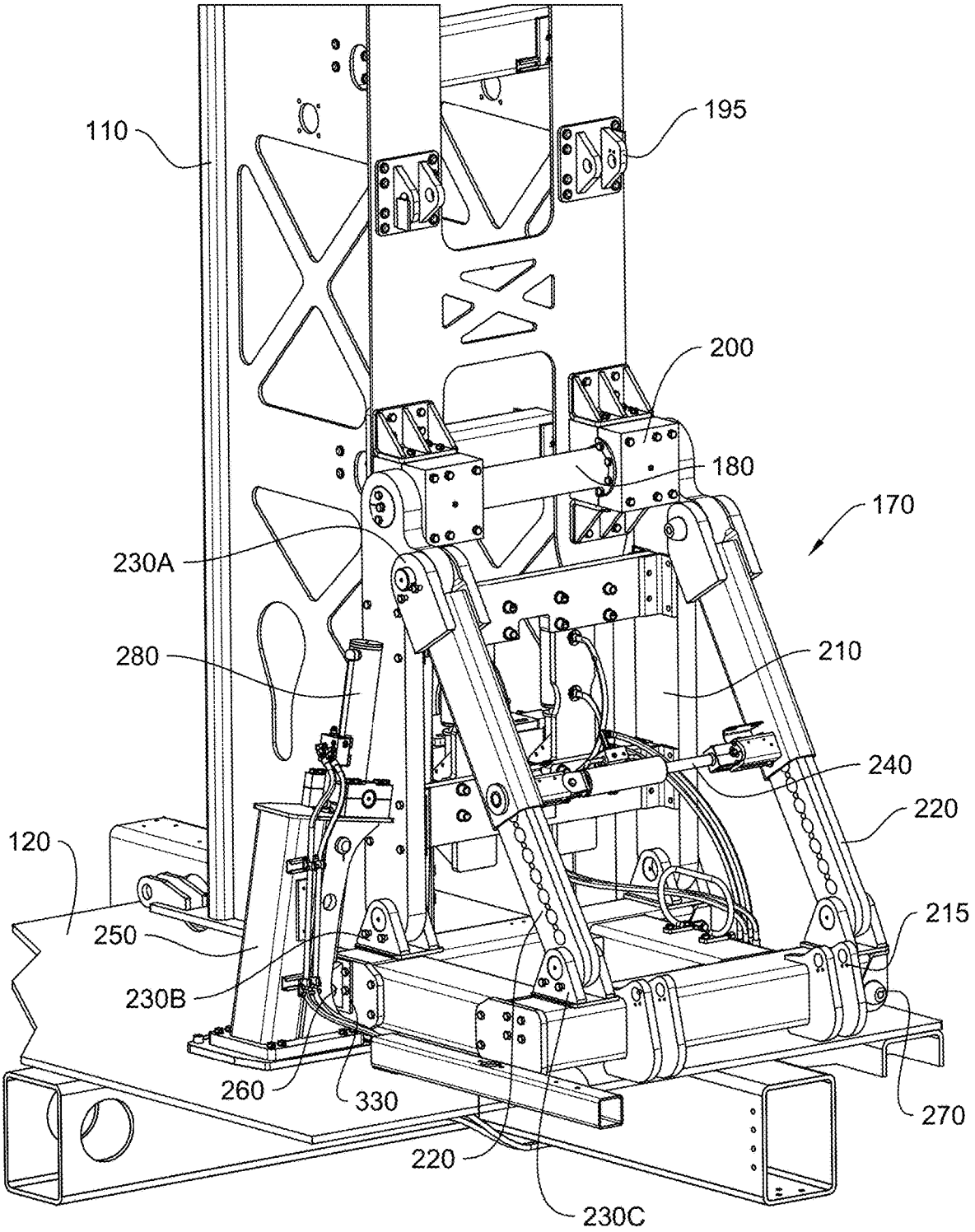
FIG. 5 shows a perspective view of an embodiment of the tower interface assembly in the position where the tower is vertical.

FIG. 5 shows in more detail an embodiment of a tower interface assembly 170, for tilting the tower 110 in the plane of the longitudinal axis 150 and in the plane of the transverse axis 160. The tower interface assembly 170 is rotatably mounted on the platform 120 and moveably couples the platform 120 and the tower 110 together so that the tower 110 can rotate relative to the platform 120 in either the plane of the longitudinal axis 150, or the plane of the transverse axis 160, or both simultaneously. As used in this disclosure, the term "simultaneously" may mean that movement of the tower 110 through both angles occurs at the same time, or it may optionally mean that the tower 110 arrives in a state of tilt in both the longitudinal axis 150 and the transverse axis 160, although the actual movement of tilting may occur first in one axis and then in the other, sequentially.

Figure 6:
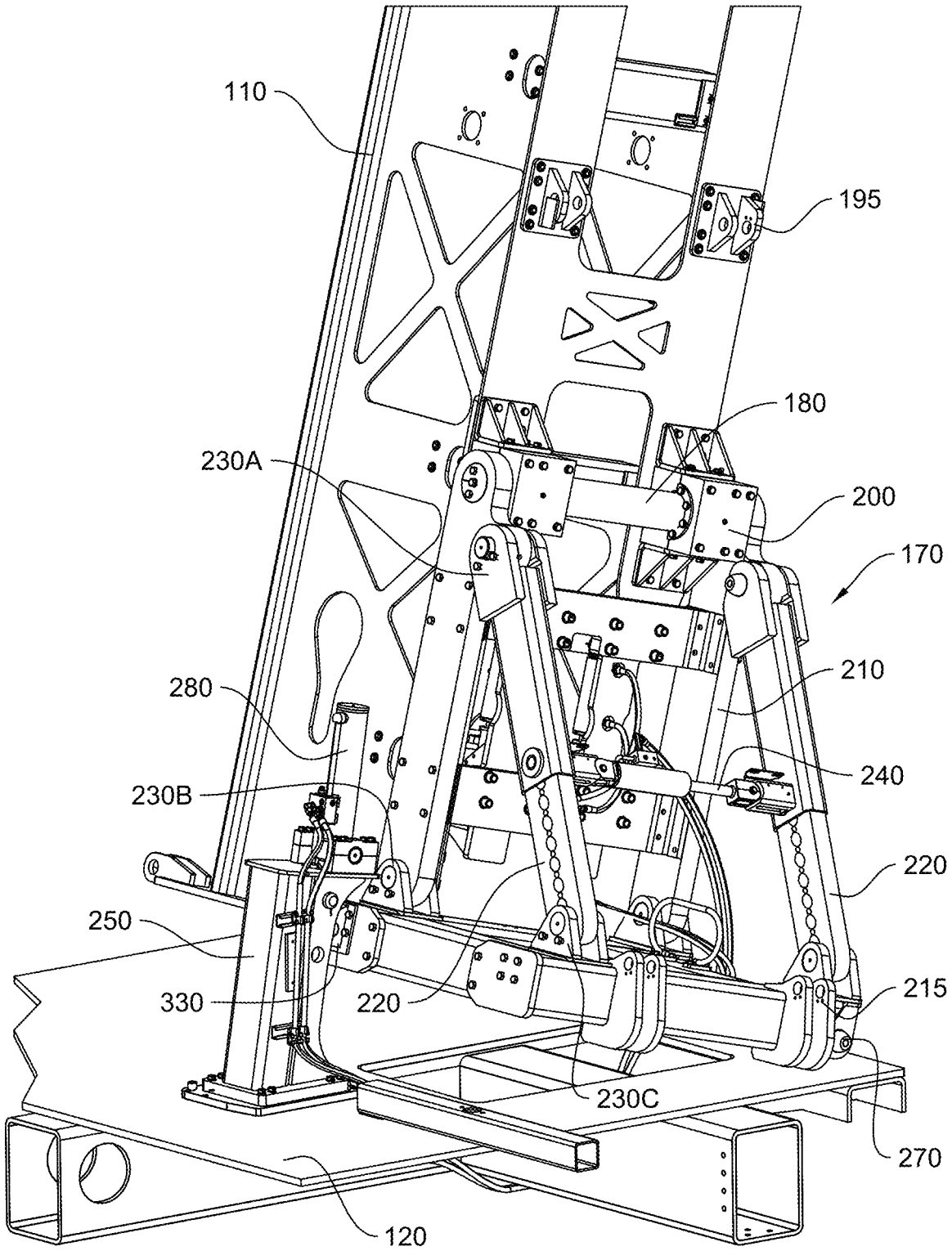
FIG. 6 shows a perspective view of an embodiment of the tower interface assembly in the position where the tower is tilted in the plane of the transverse axis.

As described below, the tower interface assembly 170 allows the tower 110 to be held at a desired predetermined angle relative to the platform 120, which predetermined angle may include a compound angle relative to the platform 120 in both the plane of the longitudinal axis 150, or the plane of the transverse axis 160, or both, so that the drilling machine 100 can be used for angled drilling FIGS. 5 and 6 show the first embodiment of the tower interface assembly 170 in more detail.

FIG. 5 is a perspective view of the tower interface assembly 170, showing the cooperating parts thereof. In FIG. 5, the tower 110 is vertical with respect to the platform 120. FIG. 6 is another view of the tower interface assembly 170, showing the cooperating parts thereof as in FIG. 5, but in FIG. 6, the tower 110 is tilted in the plane of the transverse axis.

Referring to both FIGS. 5 and 6, the tower interface assembly 170 comprises a tower pivot shaft 180 engaging tower pivot trunnions 200 affixed to the tower 110. The tower 110 is connected to a frame 210 of the tower interface assembly 170. The tower interface assembly frame 210, and thus the tower 110, can be pivoted about the tower pivot shaft 180 by action of one or more first cylinders 190 affixed to the tower 110 at pivot points 195, and rotatably connected to the frame 210 of the tower interface assembly 170 at second pivot points 215, respectively. (In this disclosure, the unqualified term "cylinder" may refer to a hydraulic or pneumatic cylinder, or to an electric actuator.) In FIGS. 5 and 6, the first cylinders 190 are omitted for clarity, so that the view of the frame 210 and its respective parts is not obscured.

The frame 210 of the tower interface assembly 170 further comprises an upper pivoting joint 230A, a lower first pivoting joint 230B, and a second lower pivoting joint 230C (where the frame 210 as shown in FIGS. 5 and 6 includes opposing and corresponding pivoting joints), which three pivoting joints cooperate to allow the frame 210 to extend or contract as the longitudinal tilt angle of the tower 110 is changed by action of the first cylinder or cylinders 190. When the tower 110 is set in the desired longitudinal angle for drilling, then that angle may be locked by pinning the two slide tubes 220 with one or more pinning cylinders 240, as shown in FIGS. 5 and 6. The pinning makes the triangle formed by the parts of the frame 210 and its pivoting joints 230A, 230B and 230C rigid.

FIG. 6 shows the tower 110 tilted in the plane of the transverse axis 160 by the mechanism of a tilt stand 250, discussed below. The tilt in the transverse direction is accomplished by rotating the frame 210 of the tower interface assembly about a pivoting tilt joint 270 fixed to the platform 120, as shown in FIGS. 5 and 6.

Figure 7B:
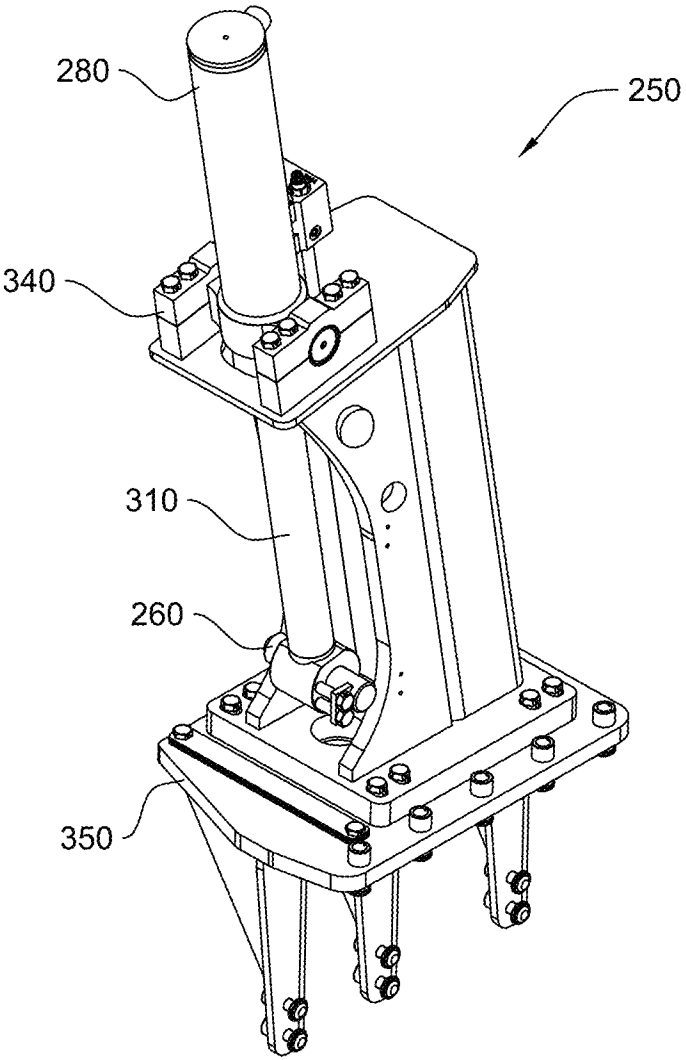
FIG. 7 shows perspective views 7A and 7B of opposite sides of the tilt stand of an embodiment of the tower interface assembly.
Figure 7A:
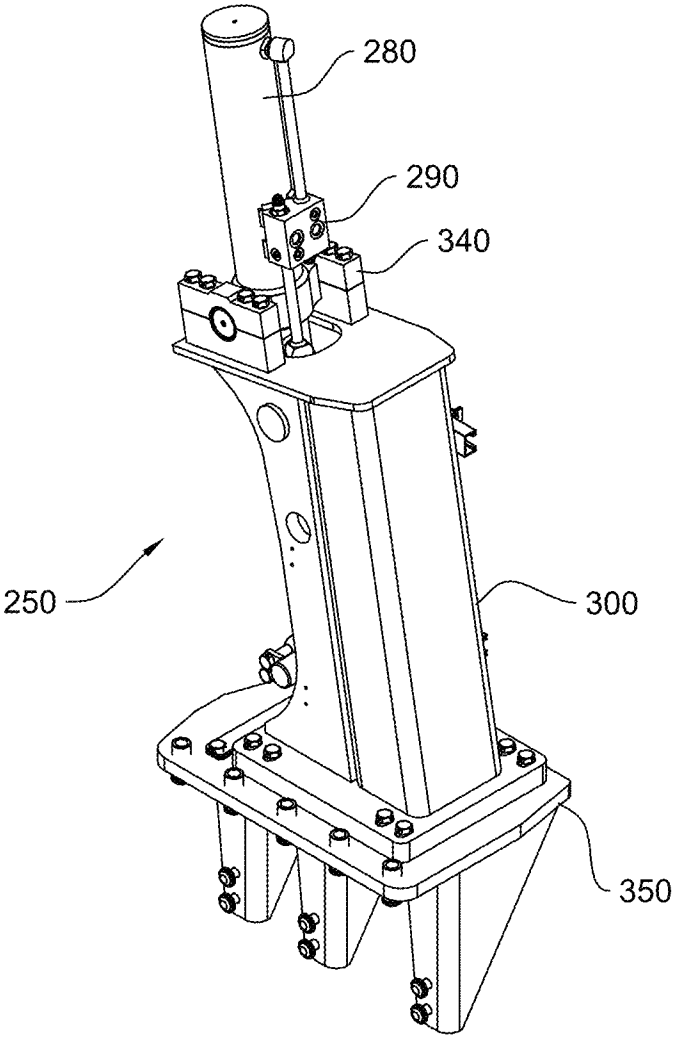

The tilt stand 250 of the first embodiment depicted is shown in more detail in FIG. 7. As shown in FIG. 7, the tilt stand 250 has a frame 300, where the frame 300 has mounting fixtures 350 for mounting the tilt stand 250 to the platform 120. The tilt stand 250 comprises at least one second cylinder 280, which second cylinder 280 is connected to the tilt stand frame 300 through trunnions 340 allowing it to tilt as the cylinder rod 310 of the second cylinder 280 is extended and retracted. The tilt stand cylinder rod 310 of the second cylinder 280 engages a clevis 330 (shown in FIGS. 5 and 6) on the tower interface assembly frame 210 through a rotating pin 260, thus causing the tower assembly frame 210 to tilt and return as the cylinder rod 310 of the second cylinder 280 is retracted and extended. Once the cylinder rod 310 of the second cylinder 280 is retracted, tilting the tower 110, a counter-balance valve 290 may be actuated to hold the second cylinder 280 in that position. In this embodiment, the tower will further be prevented from passively returning to its vertical position because when the tilt in the plane of the transverse axis 160 is more than a certain amount, the center-of-gravity of the tower 110 goes over the center of the tower support pivoting tilt joint 270, thus further preventing it from returning to its vertical position.

The reader should note that when the tilt of the tower 110 in either or both of the planes of the longitudinal axis 150 and transverse axis 160 is fixed as just described, a mobile drilling machine may be trammed from one drill site to another without changing the selected tower tilt or tilts.

Figure 8:
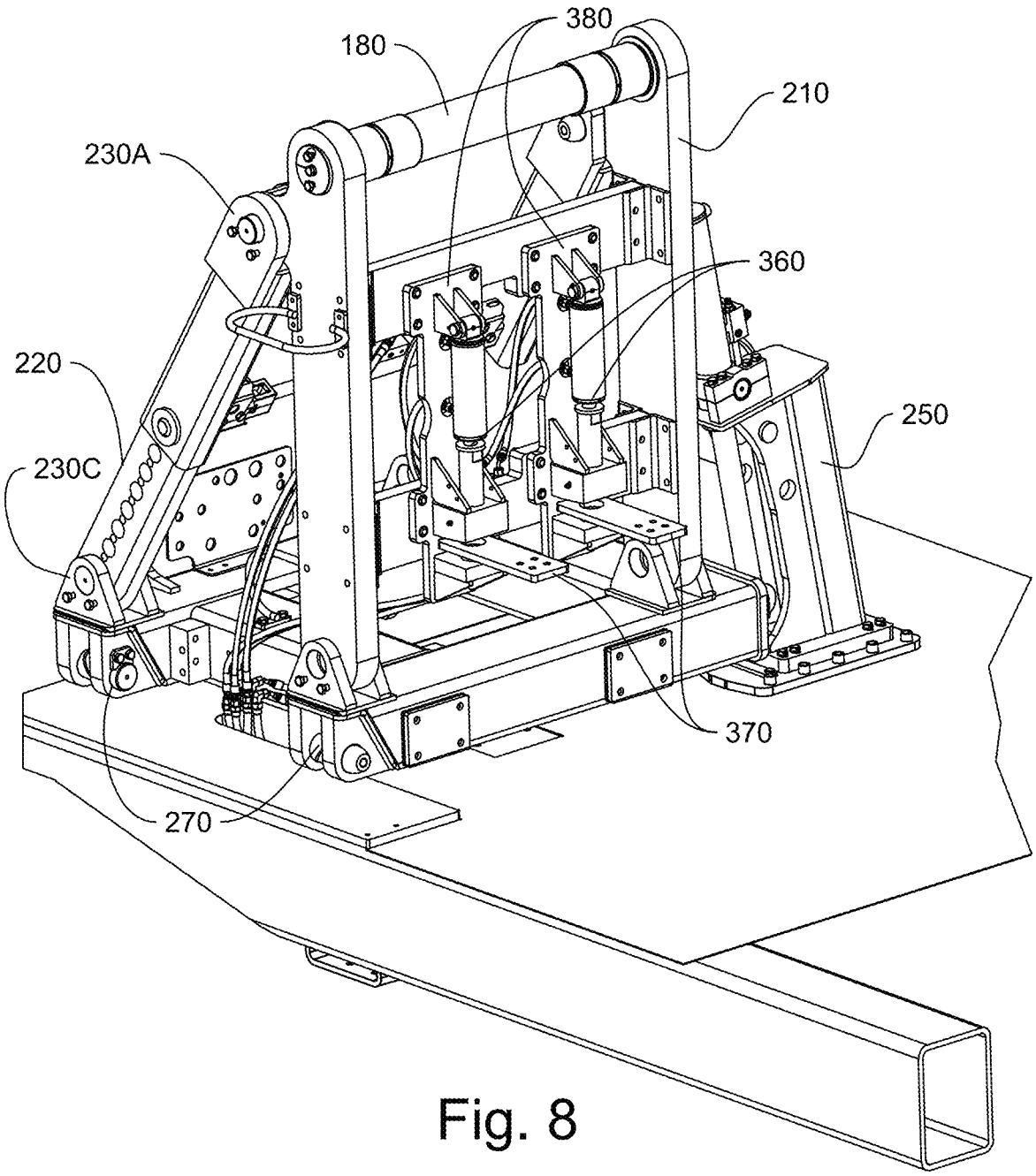
FIG. 8 shows a view of a tower pinning system.
Figure 9:
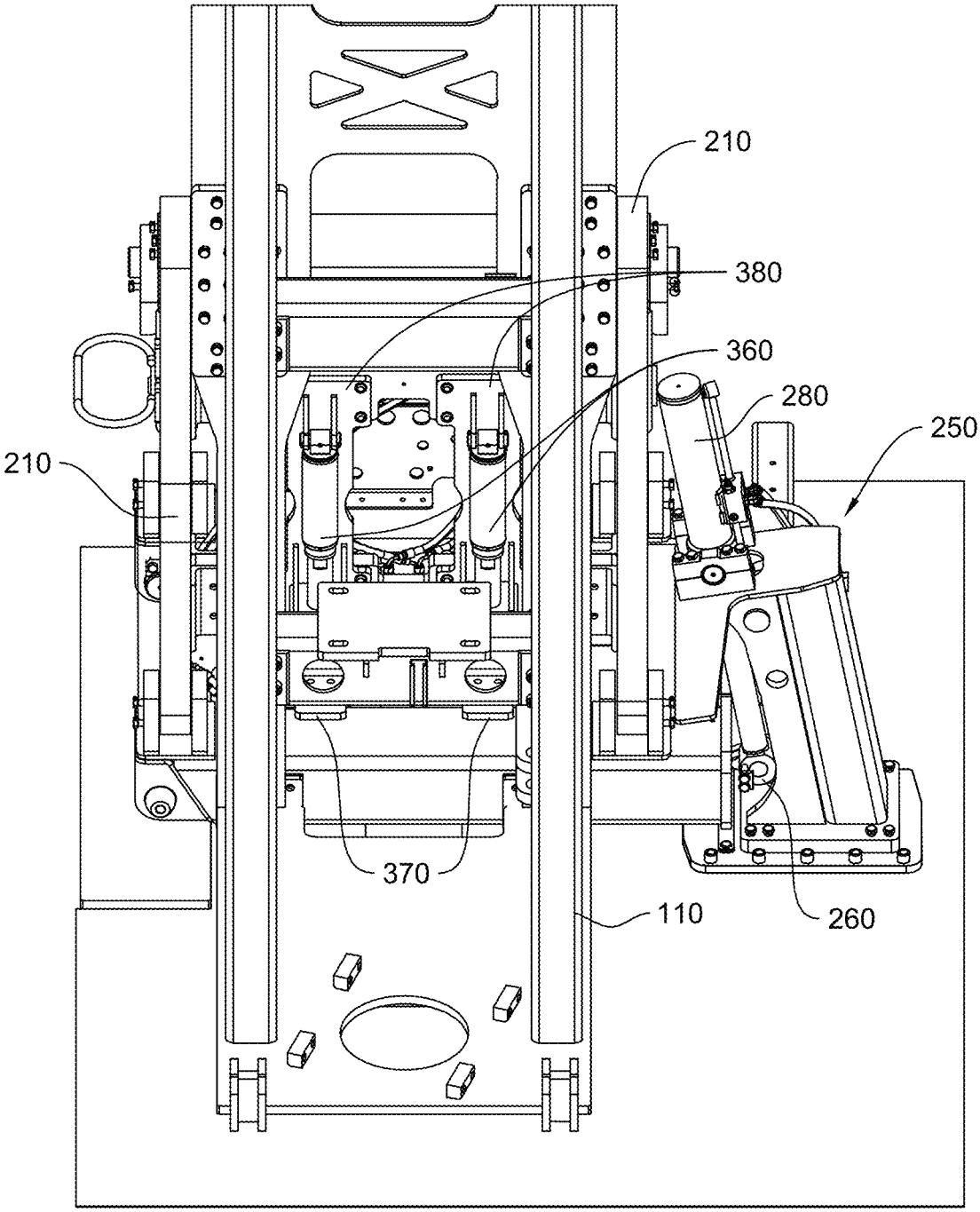
FIG. 9 shows a view of a second tower pinning system.

FIGS. 8 and 9 illustrate further systems for pinning the tilted tower 110 in a desired operating position. Pinning cylinders 360 are fixed in devises 380 on the frame 210 and operate to engage pinning plates 370, where the pinning plates 370 are connected to the tower 110, as shown in FIG. 9.

Second Embodiment

Figure 10:
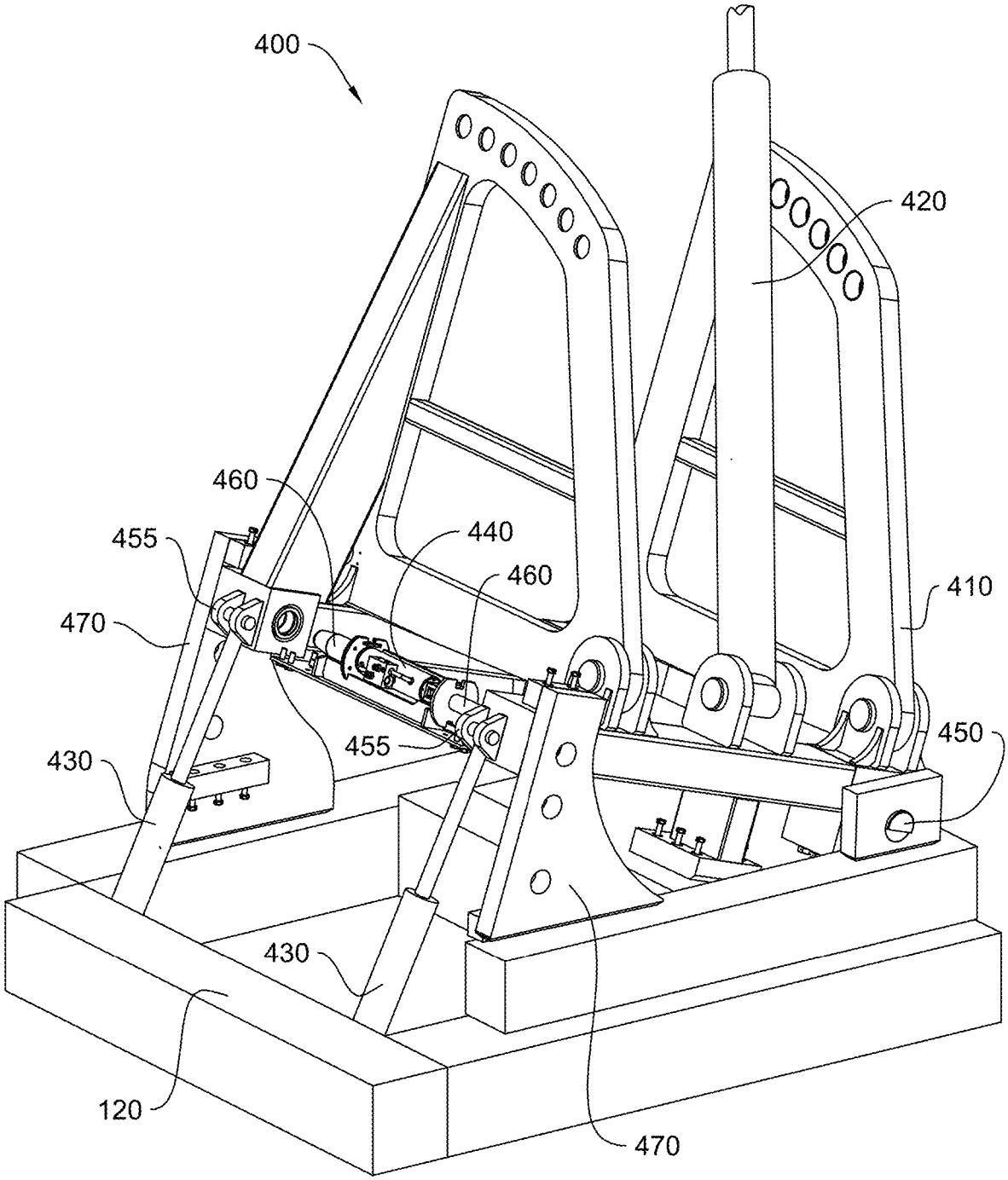
FIG. 10 shows a perspective view of an alternate second embodiment of the tower interface assembly.

FIG. 10 depicts a second embodiment 400 of the tower interface assembly 170, particularly directed to the means for effecting a transverse tilt of the tower 110 instead of the tilt stand 250 described above in connection with the first embodiment. In FIG. 10 a tower interface assembly frame 410, possibly articulated, pivots with tilt around a pivot joint 450. (A first cylinder 420 for tilting the tower 110 in the plane of the longitudinal axis 150 is also shown in FIG. 10.) In this second embodiment, the tower interface assembly frame 410 is raised and lowered by one or more second cylinders 430, connected by a pivoting connection 455 between the platform 120 and the tower interface assembly frame 410, in order to effect a tilt of the tower in the plane of the transverse axis 160. A pinning cylinder 440 in this embodiment is located on the tower interface assembly frame 410. When extended, the pinning cylinder drives pinning pins 460 into receiving holes in pinning blocks 470 mounted on the platform 120, as shown, so as to lock the transverse tilt of the tower 110 in place for the time desired.

Third Embodiment

Figure 11:
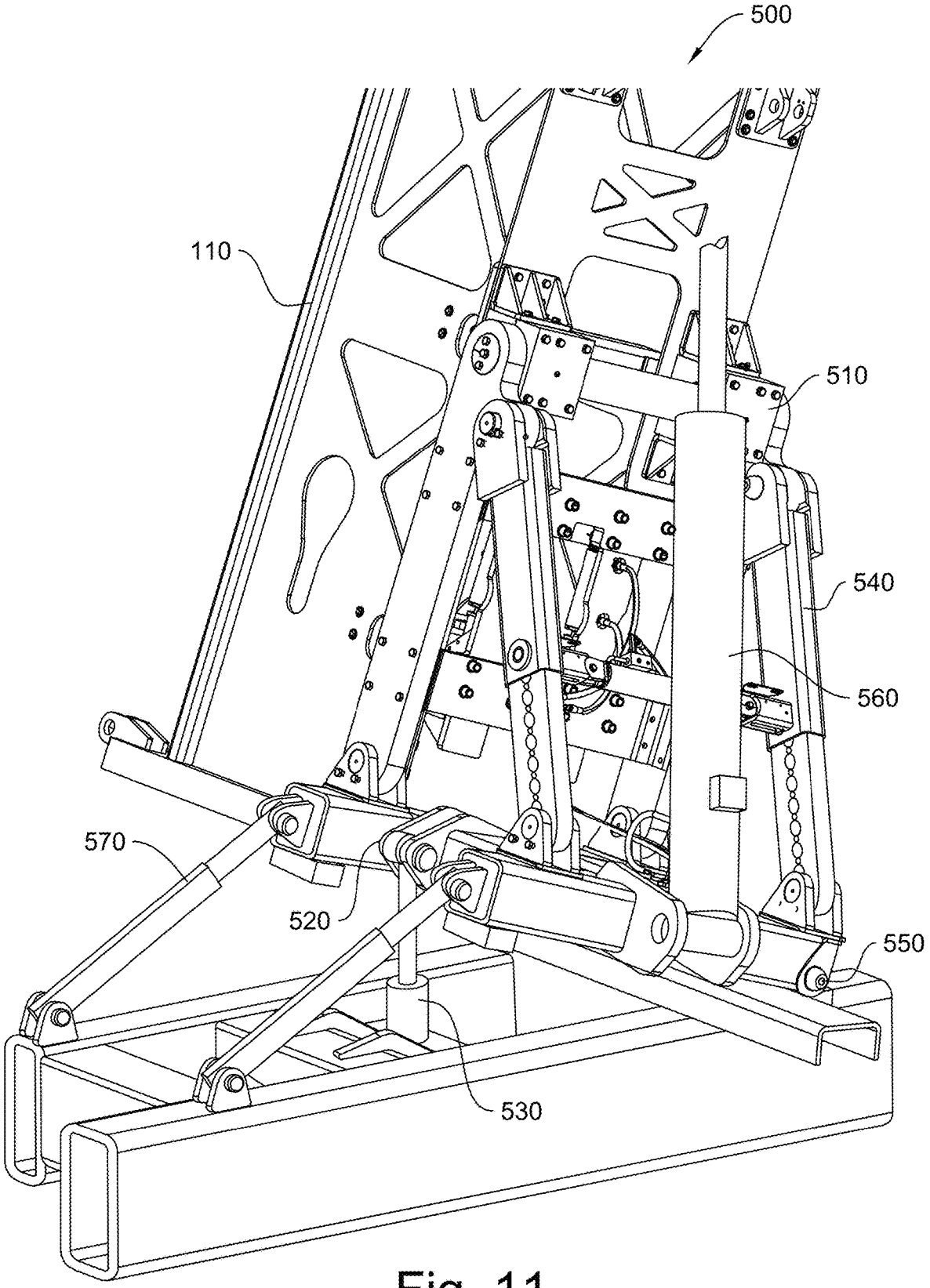
FIG. 11 shows a perspective view of an alternate third embodiment of the tower interface assembly.

FIG. 11 depicts a third embodiment 500 of the tower interface assembly 170, particularly directed to the means for effecting a transverse tilt of the tower 110, instead of the tilt stand 250 described above in connection with the first embodiment. In FIG. 11 a tower interface assembly frame 510, possibly articulated, pivots with tilt around a pivot joint 550. FIG. 11 shows first slide tubes 540 for locking the tilt of the tower 110 in the plane of the longitudinal axis, and also a first cylinder 560 for raising and lowering the tower 110 in that axis. In FIG. 11, the tower interface assembly frame 510 is tilted in the transverse axis 160 by a second cylinder 530 acting on a clevis 520. Second slide tubes 570 are provided to lock the tower interface assembly frame 510 in position for a transverse tilt by means of a pinning cylinder (not shown) acting to insert pins into sockets 580 in the second slide tubes.

None of the description in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

We claim:

1. A drilling machine for angled drilling where the drilling machine has a platform having a longitudinal axis, and a transverse axis; the drilling machine comprising:
- a tower for holding a drill string;
- a tower interface assembly connected to the platform and supporting the tower;
- wherein the tower interface assembly is selectively moveable to tilt the tower in either a plane parallel with the longitudinal axis of the platform, or to tilt the tower in a plane parallel with the transverse axis of the platform; the tower interface assembly comprising:
  - a frame; the frame moveably connected to the platform;
  - a pivot shaft connected to the frame; the pivot shaft disposed to allow the tower to tilt in the plane of the longitudinal axis about the pivot shaft;
  - at least one first cylinder connected between the tower and the platform for causing the movement of the tower in the plane of the longitudinal axis;
  - at least one slide tube connected between the platform and the frame; and,
  - at least one pinning cylinder connected to the at least one slide tube for locking the at least one slide tube in a predetermined position;
- whereby the tilted drill string can perform angled drilling in either position.

2. The drilling machine of claim 1, further comprising:
- a pivoting tilt joint; the pivoting tilt joint moveably joining the frame of the tower interface assembly to the platform;
- a clevis; the clevis connected to the frame of the tower interface assembly;
- a tilt stand;
- the tilt stand having a second cylinder;
  - the second cylinder connected between the tilt stand and the clevis to raise and lower the frame of the tower interface assembly rotatably about the pivoting tilt joint.

3. The drilling machine of claim 2, where the second cylinder further comprises a counter-balance valve for holding the position of the tower interface assembly frame in a fixed position when the counter-balance valve is actuated.

4. A drilling machine for angled drilling where the drilling machine has a platform having a longitudinal axis, and a transverse axis; the drilling machine comprising:
- a tower for holding a drill string;
- a tower interface assembly connected to the platform and supporting the tower;
- wherein the tower interface assembly is selectively moveable to tilt the tower in either a plane parallel with the longitudinal axis of the platform, or to tilt the tower in a plane parallel with the transverse axis of the platform; the tower interface assembly comprising:
  - a frame; the frame moveably connected to the platform;
  - a pivot shaft; the pivot shaft disposed to allow the tower to tilt in the plane of the longitudinal axis about the pivot shaft;
  - at least one first cylinder connected between the tower and the platform for causing the movement of the tower in the plane of the longitudinal axis;
  - a pivoting tilt joint; the pivoting tilt joint moveably joining the frame of the tower interface assembly to the platform for tilt in the plane of the transverse axis;
  - at least one pivoting connection; the at least one pivoting connection connected to the frame of the tower interface assembly;
  - at least one second cylinder connected between the pivoting connection and the platform so as to cause the tower interface assembly frame to tilt about the pivoting tilt joint when the second cylinder extends;
  - at least one pinning cylinder disposed on the tower interface assembly frame; the at least one pinning cylinder having at least one pinning pin; and,
  - at least one pinning block connected to the platform; the at least one pinning block having a plurality of holes for receiving the at least one pinning pin of the at least one pinning cylinder, so as to selectively lock the tower into a selected tilt in the plane of the transverse axis when the at least one pinning cylinder extends;
- whereby the tilted drill string can perform angled drilling in either position.

5. The drilling machine for angled drilling of claim 4, where the tower interface assembly is selectively moveable to simultaneously tilt the tower in the plane parallel with the longitudinal axis of the platform, and the plane parallel with the transverse axis of the platform.

6. The drilling machine for angled drilling of claim 4, where the tower interface assembly is selectively moveable to first tilt the tower in the plane parallel with the longitudinal axis of the platform, and thereafter to tilt the tower in the plane parallel with the transverse axis of the platform.

7. The drilling machine for angled drilling of claim 6, where the tower interface assembly is selectively moveable to first tilt the tower in the plane parallel with the transverse axis of the platform, and thereafter to tilt the tower in the plane parallel with the longitudinal axis of the platform.

8. A drilling machine for angled drilling where the drilling machine has a platform having a longitudinal axis, and a transverse axis; the drilling machine comprising:

a tower for holding a drill string;

a tower interface assembly connected to the platform and supporting the tower;

wherein the tower interface assembly is selectively moveable to tilt the tower in either a plane parallel with the longitudinal axis of the platform, or to tilt the tower in a plane parallel with the transverse axis of the platform; the tower interface assembly comprising:

a frame; the frame moveably connected to the platform; a pivot shaft; the pivot shaft disposed to allow the tower to tilt in the plane of the longitudinal axis about the pivot shaft;

a pivoting tilt joint; the pivoting tilt joint moveably joining the frame of the tower interface assembly to the platform for tilt in the plane of the traverse axis of the transverse axis;

at least one clevis; the at least one clevis connected to the frame of the tower interface assembly;

at least one first cylinder connected between the clevis and the platform so as to cause the tower interface assembly frame to tilt about the pivoting tilt joint in the plane of the transverse axis as the first cylinder extends;

a first pinning cylinder disposed on the tower interface assembly frame and having at least one pinning pin; and, at least one first slide tube connected between the platform and the frame; the at least one first slide tube having holes for receiving the at least one pinning pin of the at least one first pinning cylinder, so as to lock the tower into a selected tilt in the plane of the transverse axis;

whereby the tilted drill string can perform angled drilling in either position.

9. The drilling machine for angled drilling of claim 8, further comprising at least one second cylinder connected between the tower and the platform for causing the movement of the tower in the plane of the longitudinal axis;

at least one second slide tube connected between the platform and the frame; and, at least one second pinning cylinder connected to the tower interface assembly frame for locking the at least one second slide tube in a predetermined position.

10. The drilling machine for angled drilling of claim 8, where the tower interface assembly is selectively moveable to simultaneously tilt the tower in the plane parallel with the longitudinal axis of the platform, and the plane parallel with the transverse axis of the platform.

11. The drilling machine for angled drilling of claim 10, where the tower interface assembly is selectively moveable to first tilt the tower in the plane parallel with the longitudinal axis of the platform, and thereafter to tilt the tower in the plane parallel with the transverse axis of the platform.

12. The drilling machine for angled drilling of claim 10, where the tower interface assembly is selectively moveable to first tilt the tower in the plane parallel with the transverse axis of the platform, and thereafter to tilt the tower in the plane parallel with the longitudinal axis of the platform.

13. A drilling machine for angled drilling, where the drilling machine has a platform having a longitudinal axis, and a transverse axis; the drilling machine comprising:

a tower for holding a drill string;

a tower interface assembly connected to the platform; the tower interface moveably supporting the tower; the tower interface further comprising:

a frame, the frame moveably connected to the platform;

a pivot shaft; the pivot shaft disposed to allow the tower to tilt in the plane of the longitudinal axis about the pivot shaft;

at least one first cylinder connected between the tower and the platform for causing the movement of the tower in the plane of the longitudinal axis;

a pivoting tilt joint; the pivoting tilt joint moveably joining the frame of the tower interface assembly to the platform;

a clevis; the clevis connected to the frame of the tower interface assembly;

at least one slide tube connected between the platform and the frame; and, at least one pinning cylinder connected to the at least one slide tube for selectively locking the at least one slide tube in a predetermined position;

the tower interface assembly selectively moveable to tilt the tower in either a plane parallel with the longitudinal axis of the platform, or to tilt the tower in a plane parallel with the transverse axis of the platform;

whereby the titled drill string can perform angled drilling in either position.

14. The drilling machine of claim 13, further comprising a tilt stand; the tilt stand connected between the frame of the tower interface assembly and the platform;

the tilt stand having a second cylinder;

the second cylinder connected between the tilt stand and the clevis to raise and lower the frame of the tower interface assembly rotatably about the pivoting tilt joint; and, the second cylinder further comprising a counter-balance valve for holding the position of the tower interface assembly frame in a fixed position when the counter-balance valve is actuated.

* * * * *